US006060117A

United States Patent [19]

Pergande et al.

[11] Patent Number: 6,060,117

[45] Date of Patent: May 9, 2000

[54] MAKING AND USING THERMAL SPRAY MASKS CARRYING THERMOSET EPOXY COATING

[75] Inventors: Paul Earl Pergande, Beverly Hills; Jeffrey Alan Kinane, Birmingham; Deborah Rose Pank, Saline; David Robert Collins, Southgate, all of Mich.

[73] Assignee: Ford Global Technologies, Inc., Dearborn, Mich.

[21] Appl. No.: 09/144,618

[22] Filed: Aug. 31, 1998

[51] Int. Cl.[7] ..... B05D 3/08

[52] U.S. Cl. ..... 427/224; 427/290; 427/292; 427/386; 427/385.5

[58] Field of Search ..... 427/224, 386, 427/290, 292

[56] References Cited

U.S. PATENT DOCUMENTS 4,726,412 2/1988 Magnan et al. ..... 164/19

*Primary Examiner*—Janyce Bell
*Attorney, Agent, or Firm*—Joseph W. Malleck

[57] ABSTRACT

Method of making a mask assembly by providing a heat resistance mask substrate having an exposed surface with a surface smoothness less than 2000 micro inches, uniformly spraying a thermoset epoxy organic coating onto such exposed surface in one or more layers to provide a coating having (e.g., a thickness equal to or less than about 0.005 inches), a smoothness characterized by an average profilometer reading (Ra) of no greater than 1.5 micrometers, said coating being devoid of pores that exceed about 0003 inch in size, and flame polishing all or a portion of such coating to effect a surface finish of about 1.0 micrometers. A mask assembly which is useful in masking areas from thermal spray particles, comprising a heat resistance substrate presenting an exposed grit blasted surface having a smoothness of less than 2000, and a thin thermoset epoxy coating bonded to said exposed surface and having a surface smoothness characterized by an average profilometer reading (Ra) no greater than 1.5.

4 Claims, 3 Drawing Sheets

MAKING AND USING THERMAL SPRAY MASKS CARRYING THERMOSET EPOXY COATING

TECHNICAL FIELD

This invention relates to the technology of thermal spraying metals or ceramics, and, more particularly, to the technology of providing a low cost, flexible, self-leveling, non peelable, self-adhering coating on masks that will deflect thermally sprayed particles and prevent adherence to the mask.

DISCUSSION OF THE PRIOR ART

Thermal spraying techniques will deposit very hot viscous particles (greater than 700° C.) onto a target surface usually 3–12 inches away from the spray gun nozzle. Although techniques are available to generally control and focus the spray as a conical pattern, such sprayed pattern cannot be controlled to match all edges of the target. Accordingly, there must be a certain degree of overlap beyond the precise target edges to obtain the proper coating thickness, area definition, and physical characteristics. Accordingly, masks are used to cover surfaces adjacent to the intended coated edges to prevent adherence. Masks are usually metallic, such as polished stainless steel, to provide a smooth surface that can withstand the high heat content of the sprayed particles. Even though a metallic mask is smooth, and hard, some spray deposit eventually adheres by chemical and/or mechanical impact action over a period of repeated use. When the mask is new, hot particles will bounce off its surface and become entrained in the exhaust flow of the spray booth to be eventually collected. Once the masks become contaminated with some adhering particles, they begin to lose their ability to deflect or shed particles and an unwanted coating will adherently build up, similar to the coating on the target area. Such masks must then be scrubbed, etched or reground to be salvaged for reuse, or be discarded.

Applicant has tried several alternative protective coatings or treatments on such masks to protect them from the thermal spray, such as TiN, hard chromium, layout blueing, teflon, A2 toolsteel, cast nylon, and aluminum silicate ceramic. As a group, such alternatives have proven to be deficient because either they are to expensive for use, or the protective coating is too viscous, absorbent, or porous to deflect the thermal spray particles, or the protective film roughens the mask surface to allow a build up of the spray coating on the mask. Additionally, applicant has tried temporary films to protect the masking, such as use of shiny smooth aluminum fiberglass reinforced tape; such tapes have failed to provide durability and have had to be removed and replaced frequently.

SUMMARY OF THE INVENTION

It is an object of this invention to provide an improved mask assembly and method of making such assembly which is not only economical, but will be durable and withstand the high heat of thermal spraying particles after hundreds of independent spray cycles.

It is another object of this invention that the mask assembly and method of making present an outer coated mask surface that is self leveling, smooth and shiny, and virtually eliminate adherence of thermally sprayed particles thereagainst during the useful life of the mask.

In a first aspect, the invention is a method of making a mask assembly by (i) providing a heat resistance mask substrate having an exposed surface with a surface smoothness less than 2000 micro inches; (ii) uniformly spraying a thermoset epoxy organic coating onto such exposed surface in one or more layers to provide a coating having (e.g., a thickness equal to or less than about 0.005 inches) a smoothness characterized by an average profilometer reading (Ra) of no greater than 1.5 micrometers, said coating being devoid of pores that exceed about 0.003 inch in size; and (iii) flame polishing all or a portion of such coating to effect a surface finish of about 1.0 micrometers.

In a second aspect, the invention is a mask assembly which is useful in masking areas from thermal spray particles, comprising; (i) a heat resistance substrate presenting an exposed grit blasted surface having a smoothness of less than 2000 micro inches; and (ii) a thin thermoset epoxy coating bonded to said exposed surface and having a surface smoothness characterized by an average profilometer reading (Ra) no greater than 1.5 microns.

DETAILED DESCRIPTION AND BEST MODE

This invention has discovered that most thermally sprayed metal or ceramic materials (whether sprayed by oxy-flame, wire arc, or plasma torches) do not adhere or adhere poorly to thermoset epoxy material previously applied to masks. Surprisingly, the thermoset epoxy coating is not melted upon impact by the thermally sprayed metal or ceramic droplets. As a consequence, such coated masks eliminate the need for cleaning while providing a much longer service life. The absence of even lightly adhering metallic or ceramic particles to the coated masks eliminate the risk that such lightly adhering particles will peel off and contaminate the desired deposit of thermally sprayed particles.

Figure 1:
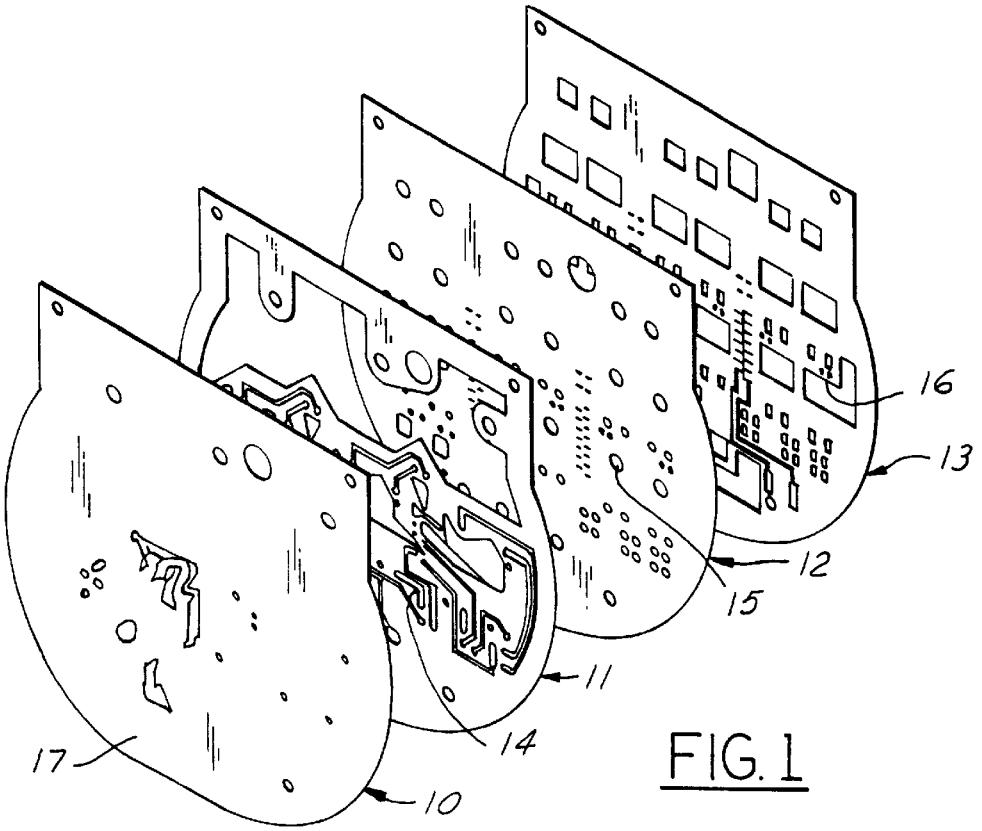
FIG. 1 is a schematic illustration of several different types of metallic masks that are used to create electrical circuitry for automotive components; different masks are shown in a separated perspective view.
Figure 4:
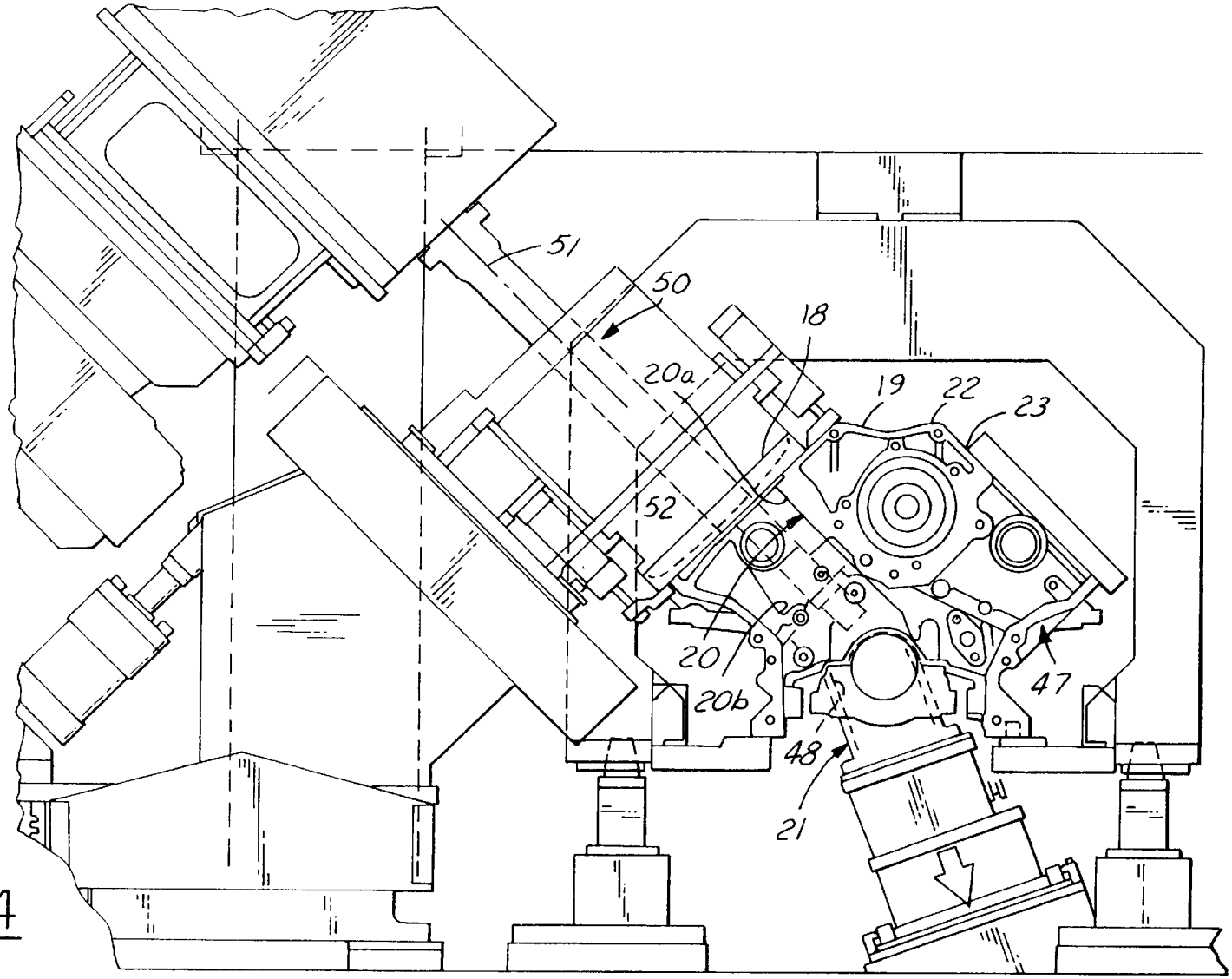
FIG. 4 is a sectional elevational view of an automotive engine block having a thermal sprayed metallic composite applied to the interior surfaces of the cylinder bores, the block being protected by a deck masks and a crank bore mask, each having previously been coated with thermoset epoxy.

Masks are typically hard smooth covers that can come in many forms. FIG. 1 illustrates several different stainless masks 10, 11, 12, 13 that are used to define different micro circuitries for automotive electrical control components. Copper is sprayed through openings in the masks (such as indicated at 14, 15 and 16) onto an insulated substrate. Unfortunately copper sticks well to the mask's raw stainless surface 17; repeated use of such uncoated masks in creating several independent circuits will result in a rapid buildup of copper on the exposed surface of the mask allowing later deposited copper particles to flake off or peel off causing contamination of the desired circuit on the insulated board. FIG. 4 further illustrates the use of two different types of masks, one mask 18 is used to cover the deck surface 19 surrounding one end 20*a* of an engine cylinder bore 20, and another mask 21 is used in the crank bore area 22 in the form of a tube angled at 23 to register with the other end 20*b* of the cylinder bore 20.

Figure 2:
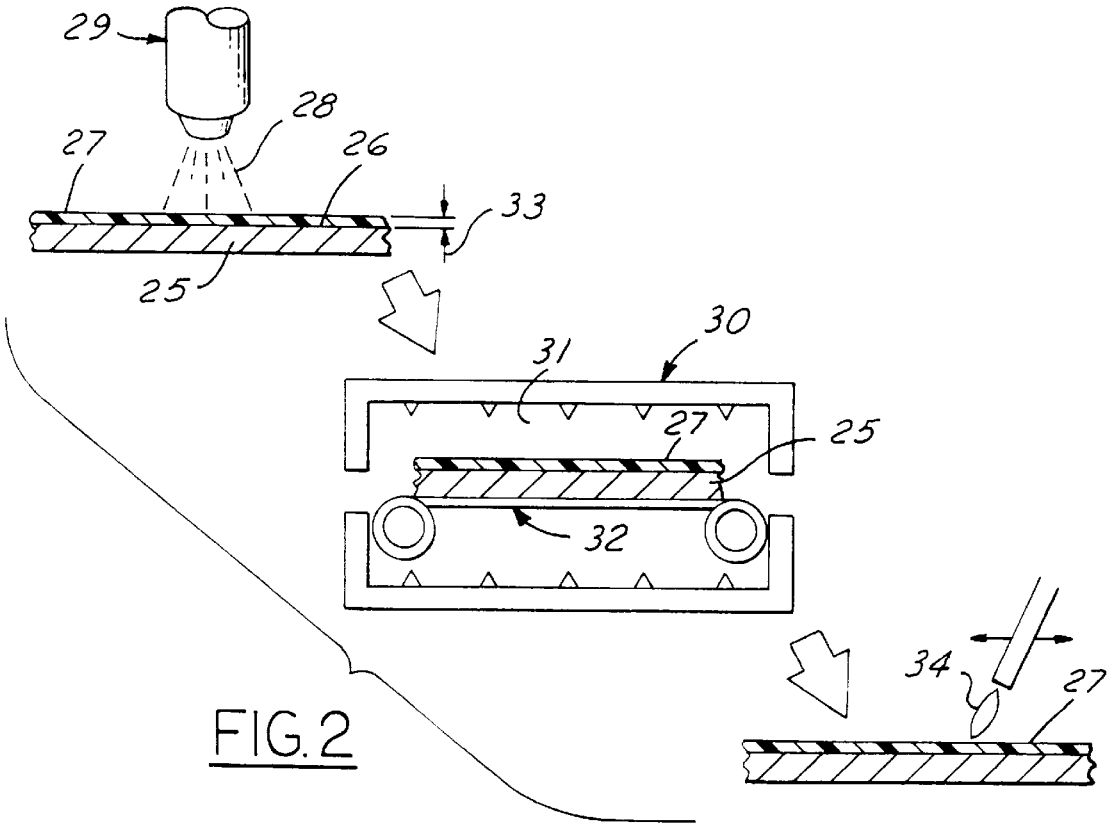
FIG. 2 is a schematic illustration of the process steps constituting this invention, here shown as applied to masks for creating electrical circuitry for automotive components.

FIG. 2 illustrates the steps of the inventive process as applied to making a coated flat mask 25 useful for spraying electrical circuitry on a flat insulation board. A stainless steel sheet, stamped with the desired cut-out openings defining the circuitry pattern, has an exposed surface 26 prepared to receive the plastic coating 27. Such surface may be primed or sand blasted to promote adhesion of the coating. The prepared surface is sprayed with a thermoset polymer (epoxy or polyester) 28 to form the coating 27. Thermoset materials, when heated, will undergo chemical change; their molecules will cross-link to create a different composition in the heated coating. A preferred composition is an epoxy powder comprised of, by weight, about 50% Bisphenol A resin, about 11% isocyanate curing agent, and the remainder essentially a barium sulfate curing agent. Flow modifiers, carbon black, $Al_2O_3$ may be present in very small amounts aggregating less than 3% by weight. Longer chain polymers obtain a smoother as-sprayed surface finish, such as polyurethane, which may be even more desirable as a mask coating. Examples of suitable commercial thermoset epoxies include the tradenames DOW 667, and Ferro VE309. Self-adherence is promoted by grit blasting the receiving surface and self-leveling is obtained because of the inherent viscosity of the melted epoxy powder. The particle size of the thermoset powder is advantageously 50–100 microns, with fine particles limited to 0–15% +200 mesh and 30–40% +325 mesh.

As shown in FIG. 2, plastic spraying can be carried out by electrostatic means 29 which requires that the cold applied coating 27 of thermoset powder be subjected to heating in an oven 30 to bake and initiate the necessary cross-linking of the polymer. The oven chamber 31 is heated to about 375° F. and the coated mask allowed to dwell therein (on a conveyor 32) for a period of about 8 minutes, although the powder will gel in 15–40 seconds.

A more preferable mode of spraying is to use a flame spray gun which inherently subjects the thermoset epoxy powder to cross-linking heating as part of the deposition process and thereby avoids separate heating. The flame spray gun may be of the oxy-fuel type where the thermoset expoy powder is fluidized by compressed air and fed into the flame of the gun. The powder is injected at high velocity through the flame of the fuel, such as propane, just long enough to allow complete melting of the powder particles. The molten particles, in the form of highly viscous droplets, deposit on the mask, forming a smooth self-leveling film upon solidification. As shown in FIG. 2, the flame spray gun usually has a body provided with air, combustion gas, and powder material supply channels. Coating quality may be increased when using liquefied gas by having the axis of the combustion gas outlet channel at an angle of 6–9° to the axis of the powder channel, thereby forming a converging flame. The amounts of air, combustion gas and powder feed are regulated by control valves. The air and liquefied gas mix in chambers forming a combustible mixture that flows to the mouth piece nozzle. As a result, the powder particles, entering the flame, are heated and applied in a molten form onto the mask surface.

The deposited coating thickness 33 must be uniform and not be greater than about 0.005 inches to (i) prevent overheating the coating when flame sprayed, (ii) avoid reflow of the viscous particles by later deposited particles causing non uniformity, and (iii) avoid opening pores in the deposit. Particularly with non-flat masks, such as dishes, cones or tubes, the coating thickness 33 must follow the mask surface 26 uniformly and be in the thickness range required. The standard deviation for smoothness of the as deposited coating is ±25% of the coating thickness. Surface roughness of the thermoset plastic coating is in the range of 0.16–1.2 Ra microns. The coating 27 has a porosity of less than 25% and is devoid of pores greater than 0.005 inches in size in the exposed surface.

To promote an even smoother plastic coating, flame polishing is used as shown in FIG. 2; a hot combustion flame 34 is brought into contact with the coating 27 and moved there across to reflow the outer skin of the coating 27. It is critical to control the dwell time of the flame on any one spot of the coating to less than 5 seconds to avoid overheating the thermoset epoxy plastic and burning the coating. Slight reflow of the coating during flame polishing will result in an enhanced surface smoothness to about 1.0 microns (Ra), which further facilitates the ability of the coating to ward off adherence of any metal or ceramic particles.

The thermoset plastic coated masks 25 achieve a new level of performance in protecting articles subjected to thermally sprayed metals or ceramics.

Figure 3:
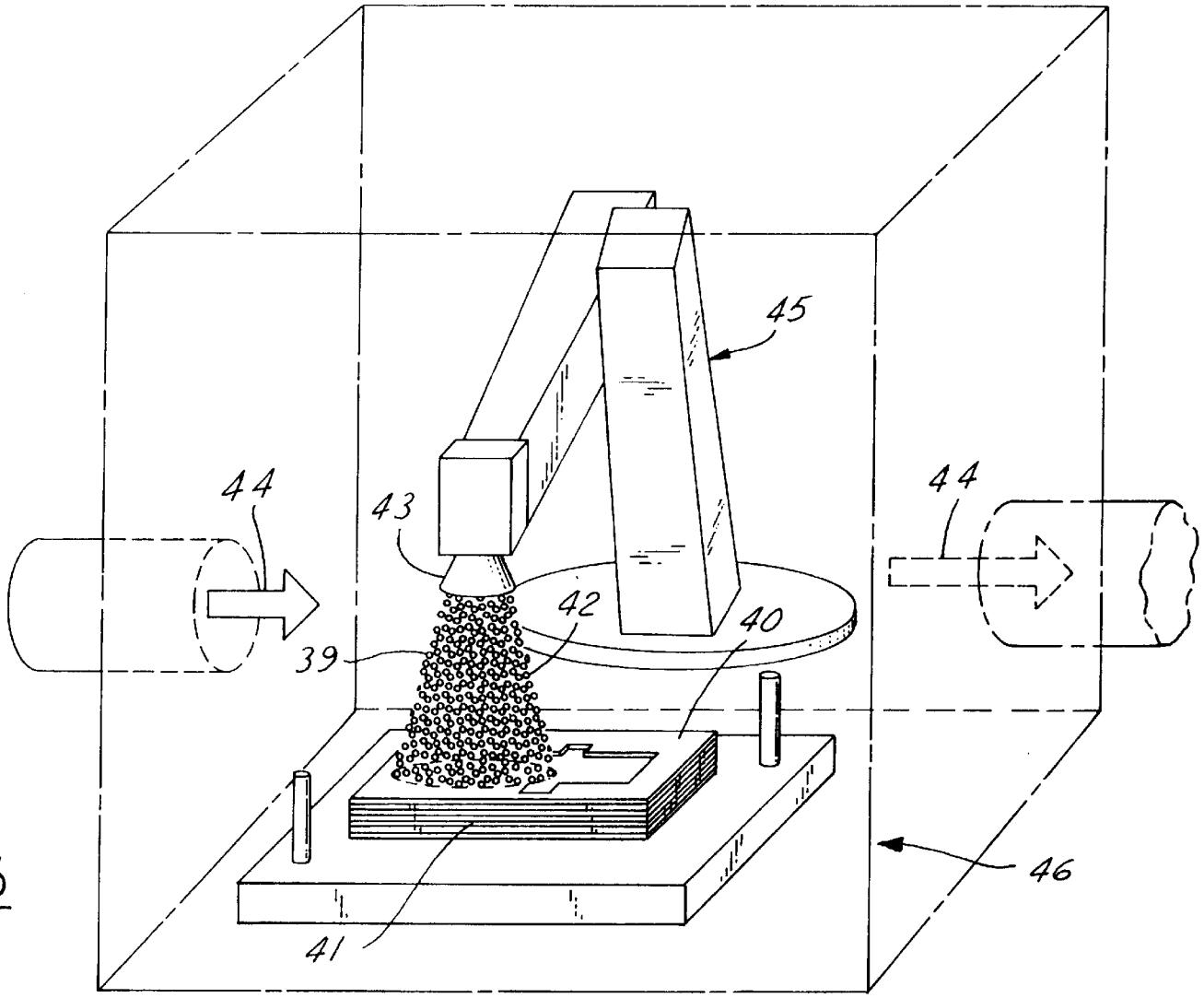
FIG. 3 is a schematic perspective view of thermal spraying apparatus applying a conductive metal to an insulating substrate through a coated mask according to this invention.

As shown in FIG. 3, one use mode for the coated masks is illustrated; copper is thermally sprayed at 39 through a thermoset coated mask 40 onto a insulating circuit board 41. The super hot viscous copper particles 42, emitted from the spray gun 43 carried on a robot 45, will bounce off the thermoset plastic coating to be entrained in an exhaust flow 44 (created in the spray chamber 46) for collection and reuse. The temperature of the metal or ceramic particles, as they hit the mask or previously layed down thermoset coating, are in the range of 875–1200° C. Extensive trials of the coated masks, according to this invention, have withstood several hundred thermal-spraying cycles with little or no evidence of any adherence of metal or ceramic particles thereto. Most importantly, there is no evidence of metal or ceramic particles building up which can be later peeled or dislodged from the masks to contaminate the useful article being thermally sprayed.

Thermal spraying of metals or ceramics, onto such protected masks, can involve use of various types of guns (powder plasma, singular or double wire-arc, oxy-fuel, or even detonation).

Thermoset epoxy coated masks as shown in FIG. 4, are used to protect against wire-arc sprayed steel. Here an annular dish or conically shaped coated mask 18 is placed on the deck surface 19 around the mouth of a cylinder bore 20 of an automotive engine block 47. Another mask 21, in the form of an angled tube, coated with thermoset polymer on its interior 48 is stationed at the crank case end 20*b* of the cylinder bore to protect the crank case area and allow for the through flow of exhaust gases 49 from the gun to entrain and carry away loose steel particles bouncing off the plastic coating of the masks.

After the coated masks are in place, as shown in FIG. 4, a thermal spray gun 50, rotating about a longitudinal axis 51, is moved into and along the length of the cylinder bore. Several different coatings may be applied by thermal spraying to the interior of the bores such as an initial bond coat consisting of nickel-aluminum, and then subsequently a top coat which is primarily constituted of steel. The particular gun that was utilized in the illustration of FIG. 4 is a plasma transferred wire-arc spray type wherein an arc is first established between a cathode and its nozzle; after creating a plasma as a result of gas flowing through such arc, the plasma and arc are transferred to the wire tip acting as a secondary anode outside the nozzle, causing the plasma to be extended and possess a heating temperature of at least 5,500° C. Steel passed through such transferred arc plasma is heated to a relatively high temperature causing the liquefied particles to impact the mask temperature at least at about 900° C.

Spray from such plasma transferred wire-arc gun will not adhere to the thermoset epoxy coating on the top deck mask 18 even after hundreds of passes of steel spray particles. This is particularly important since the top deck mask 18 has certain vertical oriented edges 52, due to its dished configuration, which would tend to normally allow for adherence of particles if uncoated.

The angled tube mask 21 receives particles at a slightly lower temperature then the deck mask, but must deflect a greater volume of sprayed particles which become entrained in the gas flow therethrough.

The use of thermoset plastic coated masks can be used for a variety of components other than masks for electronic circuitry or engine cylinder blocks; such other uses may include alternator masks, transmission plates or silicon-bronze body seam filling.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of making a mask assembly, comprising:

(a) providing a heat resistant mask substrate having an exposed surface with a smoothness of less than 2000 micro inches;

(b) uniformly spraying a thermoset organic coating onto said surface in one or more layers to provide a coating having a smoothness of less than 1.5 microns, and being devoid of pores that exceed about 0.005 inch in size; and (c) flame polishing all or a portion of the coating to effect a surface finish of about 1.0 microns.

2. The method as in claim 1, in which said thermoset organic coating is comprised of epoxy or polyester.

3. The method as in claim 2, in which said epoxy is comprised of, by weight, about 50% bisphenol A, about 11% isocyanate curing agent, and the remainder essentially an extender.

4. The method as in claim 1, in which step (b) is carried out to provide a coating thickness equal to or less than about 0.005 inches.

* * * * *